US005151297A

United States Patent [19]

Robbins et al.

[11] Patent Number: 5,151,297

[45] Date of Patent: Sep. 29, 1992

[54] THERMOPLASTIC ACRYLIC COATED STEEL SHEET

[75] Inventors: Douglas J. Robbins, Hamilton; Cynthia A. Gosselin; Frederick A. Myers, both of Middletown, all of Ohio

[73] Assignee: Armco Steel Company, L.P., Middletown, Ohio

[21] Appl. No.: 499,230

[22] Filed: Mar. 26, 1990

[51] Int. Cl.[5] ..... B05D 3/02; B05D 1/28; B05D 7/14

[52] U.S. Cl. ..... 427/46; 427/178; 427/211; 427/388.1; 427/388.4; 427/406; 427/409; 427/428

[58] Field of Search ..... 427/46, 178, 211, 328, 427/359, 366, 384, 388.1, 388.2, 388.3, 388.4, 406, 409, 410, 428

[56] References Cited

U.S. PATENT DOCUMENTS

| | | | |
|---|---|---|---|
| 3,873,458 | 3/1975 | Parkenson | 427/428 |
| 4,303,537 | 12/1981 | Laepple et al. | 252/30 |
| 4,376,024 | 3/1983 | Andersson et al. | 427/388.4 |
| 4,411,145 | 10/1983 | Lewis et al. | 72/42 |
| 5,045,361 | 9/1991 | Kerherve | 427/388.1 |
| 5,055,325 | 10/1991 | Trivett | 427/388.1 |
| 5,061,518 | 10/1991 | Langerbeins et al. | 427/388.1 |

FOREIGN PATENT DOCUMENTS

| | | |
|---|---|---|
| 282079 | 9/1988 | European Pat. Off. . |
| 363824 | 4/1990 | European Pat. Off. . |

OTHER PUBLICATIONS

Abstract of 57/136977, Japanese Pat. Doc.; Aug. 1982.
Abstract of 63/227,699, Japanese Pat. Doc.; Sep. 1988.
Abstract of 2,488,676, France, Pat. Doc; Feb. 1982.

*Primary Examiner*—Marianne Padgett
*Attorney, Agent, or Firm*—R. J. Bunyard; L. A. Fillnow; R. H. Johnson

[57] ABSTRACT

Zinc or zinc alloy plated steel sheet ready for deep drawing coated with 1-5 gm/m$^2$ of a dry, tack free continuous thermoplastic acrylic coating. The coating is formed by inductively heating the sheet to a temperature of about 149°-246° C. for no more than 10 seconds after being roll coated with a continuous liquid film of an aqueous solution including an acrylic polymer. The acrylic coating forms a protective film that is impervious to moisture, oil, and dirt, is able to be welded and adhesively bonded and possesses sufficient toughness and lubricity to allow deformation of the sheet without additional external lubricant. A deep drawn article formed from the sheet has enhanced painting characteristics after the acrylic coating is removed and the article is coated with a phosphate coating.

5 Claims, No Drawings

THERMOPLASTIC ACRYLIC COATED STEEL SHEET

BACKGROUND OF THE INVENTION

This invention relates to a steel sheet having a protective coating and production thereof. More particularly, this invention relates to a steel sheet having a thermoplastic acrylic coating that is impervious to moisture, oil, dirt, and the like during handling and forming, is capable of being welded and adhesively bonded, and has sufficient lubricity for deep drawing the sheet without needing additional lubricant.

Forming of steel sheets requires a lubricant to prevent scoring and galling during stamping. Liquid lubricants such as oil generally are considered unsatisfactory for a number of reasons. Oils have a tendency to age over time, especially when exposed to elevated temperature such as stamping press temperatures and storage temperatures. Aging causes oils to polymerize and become difficult to remove after forming a sheet. This especially is apparent on relatively porous zinc electroplated steels. Oil may become embedded in the sheet surface and causes an inconsistent appearance when the sheet is given a phosphate coating after cleaning. Oil also may remain trapped inside hem flange joints during stamping. If the sheet is then painted, the oil volatilizes during curing of the paint leading to cratering. Cratering of the paint results in an unacceptable surface appearance and poor corrosion. Oils also are a safety concern in the work area, result in a severe housekeeping problem, and generally cause operator dissatisfaction because of odor and air contamination.

In the automotive industry, it is known to apply a dry coating containing a soap to steel sheet. Dry soap coatings have very good lubricating characteristics for press forming and have minimized the safety concern since additional external liquid lubricant generally is not required in forming operations. Unfortunately, soaps are hydrophilic in nature and moisture causes tackiness in the soap film. This moisture may result in stamping die pickup of the soap, short blanking of the sheet, and sticking of a formed article in the dies. These problems cause dings, dents, and the like when removing formed articles from the dies. The moisture also may result in poor corrosion protection.

U.S. Pat. No. 4,411,145 discloses a composition for an aqueous solution containing an acrylic polymer, a wax, and a finely divided molybdenum disulfide for coating steel for can making. The patent suggests a dry coating formed from the solution does not rub off during handling or ironing of the sheet and has sufficient lubricity to prevent scoring and galling during formation of cans. The aqueous solution is applied as a liquid film to one side of the sheet by spraying, using a roller or wiping and thereafter dried. After the sheet is ironed, the dry film is removed from the cans by washing in an alkaline solution. The patent discloses a dry coating thickness of 5-200 mg/ft$^2$ molybdenum disulfide.

Unlike thin gauge steel for can making, heavier gauge steels for deep drawing applications such as automobile and appliances have more severe surface requirements. The sheet surface generally is rougher, particularly for galvanized sheet, and the types of dry coatings described above are inadequate because the coating does not form a continuous, polymerized film impervious to contamination. Furthermore, hold down pressure for deeply drawn sheets may be inadequate to form articles having consistent dimensions and uniform stretching/-stiffness characteristics. Formed articles also may require welding or adhesive bonding prior to removal of the dry coating. The coating not only must have uniform thickness to provide the necessary lubricity but also not insulate sheets or formed articles during resistance welding. The coating must still be impervious to contamination after forming to protect the sheet base metal from corrosion while the unfinished formed articles are in storage awaiting further processing. For formed articles to be painted, the lubricant film must be able to be completely removed so that the painting characteristics are enhanced.

Accordingly, there remains a long felt need for a dry organic coating for deeply drawn steel sheet that is tack free, is hydrophobic, provides good corrosion protection, and has sufficient lubricity so that additional lubricant is not required during forming of the sheet. The coating also must be impervious to contamination during handling of the sheet before and after forming and during welding and easily be removed after forming so that the article surface has enhanced painting characteristics.

BRIEF SUMMARY OF THE INVENTION

A steel sheet ready for deep drawing is coated with a dry, tack free continuous thermoplastic acrylic coating having a uniform thickness on at least one side of the sheet and has sufficient lubricity to allow deformation of the sheet without additional lubricant. The coating is impervious to moisture, oil, dirt, and the like, is weldable and is capable of being adhesively bonded with a variety of adhesives without adversely effecting bond strength. The one side of a deeply drawn article formed from the sheet has enhanced painting characteristics after the acrylic coating is removed.

A principal object of the invention is to provide a dry, tack free hydrophobic coating that protects a steel sheet during handling and after forming from corrosion, oil, dirt, and the like.

An additional object includes providing a coating that has sufficient lubricity to allow the coated sheet to be deeply drawn without needing additional external lubricant.

An additional object includes providing a coating that has improved storage life.

A feature of the invention includes a steel sheet ready for deep drawing coated with a dry, tack free continuous thermoplastic acrylic coating having a coefficient of friction of no greater than about 0.05 and being impervious to moisture, oil, dirt, and the like.

Another feature of the invention includes a steel sheet ready for deep drawing coated with a dry, tack free continuous thermoplastic acrylic coating having a weight of 1-5 gm/m$^2$ on at least one side of the sheet and being impervious to moisture, oil, dirt, and the like.

Another feature of the invention includes a steel sheet ready for deep drawing coated with a dry, tack free continuous thermoplastic acrylic coating having a weight of 1-5 gm/m$^2$ on at least one side of the sheet, the coating having a coefficient of friction of no greater than about 0.05 and being impervious to moisture, oil, dirt, and the like.

Another feature of the invention includes the acrylic coated steel sheet whose substrate has a thickness of at least 0.35 mm and plated with zinc or a zinc alloy on the one side.

Another feature of the invention includes a weldable acrylic coated sheet whose coating weight on at least one side of the sheet does not exceed about 3.4 gm/m$^2$.

Another feature of the invention includes protecting steel sheet by roll coating a continuous liquid film of an aqueous solution containing a thermoplastic acrylic polymer onto at least one side of the sheet, heating the coated sheet at an elevated temperature for sufficient time to form a dry, tack free acrylic coating impervious to moisture, oil, dirt, and the like, the coated sheet ready for deep drawing without additional external lubricant.

Another feature of the invention includes inductively heating the liquid film to a temperature of about 149°-246° C. for no more than 10 seconds.

Another feature of the invention includes drawing the coated sheet into a formed article, cleaning the article with an alkaline solution to remove the acrylic coating, and phosphate coating the side of the article so that the side has enhanced painting characteristics.

Advantages of the invention include acrylic coated sheets that can be unstacked without sticking to one another, can be readily welded or adhesively bonded together, elimination for additional lubricant when forming the acrylic coated sheets, no clean up of liquid lubricants in the work area around the forming presses, an acrylic coating that easily is removed after the sheets are formed, higher hold down pressures and reduced blank sizes, and enhanced paintability after the acrylic coating is removed and replaced with a phosphate coating.

DETAILED DESCRIPTION OF THE PREFERRED EMBODIMENT

Steel sheet, having a thickness of about 0.35 mm or thicker, preferably is plated with zinc or a zinc alloy on at least one side of the sheet such as by electroplating. It will be understood by steel sheet is meant to include both cut lengths and continuous strip. At least one side of the sheet is roll coated with a liquid film of an aqueous solution containing a thermoplastic acrylic polymer. For a high speed zinc plating line, the coated sheet is quickly dried by being heated to a temperature of 100°-300° C. and for a time sufficient to dry the liquid film to a dry, tack free acrylic coating whereby the coating has uniform thickness and is tightly adherent to the sheet. The coated sheet preferably is dried in 10 seconds or less by passing through an induction coil while being heated to a temperature of 149°-246° C. After drying, the coated sheet may be air quenched and rolled into a coil or stacked into cut lengths ready for forming. The coated sheet may be formed immediately or stored indefinitely.

Since the coating has a hard surface, coated sheets can be wound into a coil or stacked into cut lengths without the sheets sticking together or the coating pulling away from the sheet surfaces when the sheets are separated. Furthermore, the coating has good toughness resulting in consistent lubricity when forming the sheets. By hard is meant a mar resistant, tack free finish.

After forming, two or more of the coated articles may be resistance welded or adhesively bonded into a larger article such as the outer shell of an automobile. Thereafter, the coating easily is removed from the article such as by dipping with an alkaline solution having a pH of at least 8. The coating may be removed immediately or the formed articles can be stored indefinitely awaiting further finishing. Because the coating remains continuous even during and after forming, the articles can be stored in a hostile environment without corrosion not otherwise possible with petroleum or soap lubricants. Articles to be painted may be dipped into a phosphate containing acid solution after the acrylic coating is removed. Unlike previously used petroleum and soap lubricant coatings, the tough surface of the acrylic coating returns the surface of formed parts to the original pristine condition of the sheet prior to applying the coating. Apparently, the acrylic coating is impervious to contamination and neither the coating nor contamination becomes embedded in the pores of the sheet during handling and forming. The pristine surface condition is advantageous for painting a phosphated surface because very small and uniformly sized phosphate crystals result giving a very attractive paint appearance resulting in more consistent corrosion performance.

The aqueous solution is applied to the sheet and then dried using conventional coating and heating equipment. However, a roll coater must be used to apply the liquid film because of the precise coating weight requirements necessary for sheet to be deeply drawn. The dry acrylic coating must have sufficient weight/thickness to obviate applying additional external lubricant to the sheet or presses immediately prior to forming. It was determined zinc plated sheet needed an acrylic coating weight at least about 1.2 gm/m$^2$ (0.8 mg/in$^2$) for this lubricity requirement. When the minimum coating weight was properly controlled, the coefficient of friction for the acrylic coated sheets was determined to be about 0.05 or less, regardless of the substrate type. It also was determined the acrylic coating weight preferably should not exceed 3.4 gm/m$^2$ (2.2 mg/in$^2$). At greater weights, the coating acted as an insulator increasing the resistance to current passing between a pair of opposing sheets during resistance welding. Using a roll coater guaranteed the weight necessary for lubricity during forming, a continuous coating having uniform thickness over the sheet surface, and provided the control necessary so that the coating thickness did not exceed that required for easy resistance welding.

It was indicated above the aqueous solution contained an acrylic polymer for forming a dry acrylic coating having a weight at least about 1.2 gm/m$^2$. It will be understood the aqueous solution may contain small amounts of one or more auxiliary substances such as rust inhibitors, wetting agents, wax, antifoaming agents, and the like so long as more than 50% by weight of the dry lubricant coating composition is a thermoplastic acrylic polymer.

An induction heater advantageously is used for a high speed coating line because the amount of floor space necessary for a convection oven would be excessive. An induction coil can be used to heat the sheet substrate to a temperature of about 149°-246° C. to dry the liquid film to a tack free condition and cooling thereafter to ambient all in less than 30 seconds. Another reason for using induction heating is because an induction coil heats the steel substrate which in turn then heats the liquid film, i.e., the liquid film is heated from the inside out. Unlike air convection ovens which would heat the outer surface of the liquid film first, induction heating allows bubbles formed during drying of the liquid to escape from the coating. Such bubbles otherwise may become trapped within the coating causing blisters. Blisters could result in uncoated areas which would corrode or cause sheet surface scoring during forming.

The following example will better illustrate the invention. A low carbon steel strip having a thickness of 0.79 mm and a width of 22.9 cm was electroplated with a pure zinc coating. After plating, the strip was passed between a pair of opposed rollers where a liquid film of an aqueous solution containing an acrylic polymer was added to both surfaces of the strip. The aqueous solution containing the acrylic polymer was supplied by PPG Industries. The strip was then passed through a 30 cm long induction coil having 8 turns for 6 seconds with the strip being heated to 200° C. After air quenching, the acrylic coated strip was wound into a coil. The coating was sufficiently dry and tack free so that the coating remained tightly adherent to the strip without causing the laps to stick to one another when the coil was unwound.

Additional zinc plated steel strip was coated with a liquid film from the aqueous solution and dried in the manner described in the example above. The line speeds for coating the liquid film onto the strip, the times within the induction coil and the drying temperatures are shown in the table below.

| Sample | Strip Speed (m/min) | Time (sec) | Strip Temp (°C.) |
|---|---|---|---|
| 2 | 3.1 | 6.1 | 343 |
| 3 | 7.6 | 2.4 | 193 |
| 4 | 15.2 | 1.2 | 193 |
| 5 | 22.9 | .8 | 154 |
| 6 | 30.5 | .6 | 132 |

All the coatings produced using the times and temperatures in samples 3–6 were dry, tack free, and had good adherence to the strip. The coating for sample 2 was degraded apparently because it was heated at too high a temperature. This coating had poor adherence and poor lubricity characteristics.

A low carbon deep drawing steel strip having a thickness of 0.71 mm and a width of 144.8 cm was electroplated at a speed of 90 m/min. on one side of the strip with a pure zinc coating having a coating weight of about 30 gm/m$^2$. After plating, the strip was passed between a pair of opposed rollers where a liquid film of the aqueous solution containing the acrylic polymer was added to both surfaces of the strip. The coated strip was dried by being passed through a convection oven. The strip was in the oven for 30 seconds with the coating being heated to 200° C. After air quenching, the acrylic coated strip was wound into a coil. The coating was sufficiently dry and tack free so that the coating remained tightly adherent to the strip without causing the laps to stick to one another when the coil was unwound. The weight of the acrylic coating on the zinc plated side of the strip ranged from 1.9 to 2.2 gm/m$^2$. The weight of the acrylic coating on the cold reduced (unplated) side of the strip ranged from 2.6 to 2.7 gm/m$^2$. This steel was successfully formed into body side outer parts for an automobile. Additional external lubricant was not necessary during the forming of these articles, the articles did not stick in the dies of the presses and the coating did not buildup on the dies. Because of higher lubricity, hold down pressures could be increased and complex body side parts formed using smaller blank sizes.

It will be understood various modifications can be made to the invention without departing from the spirit and scope of it. Therefore, the limits of the invention should be determined from the appended claims.

We claim:

1. A method of forming a dry lubricant coating on steel ready for deep drawing, including the steps of:

providing a steel sheet, the surfaces of said sheet being uncoated or metallic coated, providing an aqueous solution of a thermoplastic polymer, said thermoplastic polymer consisting essentially of acrylic and small amounts of auxiliary substances from the group of a rust inhibitor, a wetting agent, a wax and an antifoaming agent, roll coating a continuous liquid film of said solution onto at least one side of said sheet, inductively heating said sheet to a temperature of about 149°–246° C. for no more than 10 seconds to form a coating containing more than 50 wgt. % of said acrylic polymer, the outer coated surface of said sheet being dry and tack free, said coating being impervious to moisture, oil, dirt, and capable of being welded and adhesively bonded, said coated sheet being ready for deep drawing without additional external lubricant.

2. The method of claim 1 wherein said coating has a coefficient of friction of no greater than about 0.05.

3. The method of claim 1 wherein said coating is 1–5 gm/m$^2$ on said one side.

4. The method of claim 1 wherein said metallic coating is zinc or a zinc alloy.

5. The method of claim 1 wherein said coating is 1.2–3.4 gm/m$^2$ on said one side.

* * * * *